US011519428B2

(12) United States Patent
Wendland

(10) Patent No.: US 11,519,428 B2
(45) Date of Patent: Dec. 6, 2022

(54) PNEUMATIC PUMP CONTROL SYSTEM

(71) Applicant: Robert Wendland, Deland, FL (US)

(72) Inventor: Robert Wendland, Deland, FL (US)

( * ) Notice: Subject to any disclaimer, the term of this patent is extended or adjusted under 35 U.S.C. 154(b) by 44 days.

(21) Appl. No.: 17/198,905

(22) Filed: Mar. 11, 2021

(65) Prior Publication Data

US 2021/0199109 A1 Jul. 1, 2021

Related U.S. Application Data

(63) Continuation-in-part of application No. 16/163,120, filed on Oct. 17, 2018, now abandoned.

(60) Provisional application No. 62/573,480, filed on Oct. 17, 2017.

(51) Int. Cl.

| | |
|---|---|
| ***F04F 1/06*** | (2006.01) |
| ***F04B 9/12*** | (2006.01) |
| ***F04B 49/03*** | (2006.01) |
| ***F04F 1/08*** | (2006.01) |
| ***F04D 29/70*** | (2006.01) |
| *F04B 53/10* | (2006.01) |
| *E21B 43/12* | (2006.01) |
| *F04B 53/06* | (2006.01) |

(52) U.S. Cl.

CPC ..... *F04F 1/06* (2013.01); *F04B 9/12* (2013.01); *F04B 49/03* (2013.01); *F04D 29/708* (2013.01); *F04F 1/08* (2013.01); *E21B 43/129* (2013.01); *F04B 53/06* (2013.01); *F04B 53/1002* (2013.01)

(58) Field of Classification Search

CPC .. F04B 9/12; F04B 49/03; F04B 53/06; F04B 53/1002; F04F 1/06; F04F 1/08; E21B 43/129

See application file for complete search history.

(56) References Cited

U.S. PATENT DOCUMENTS

| | | | | | |
|---|---|---|---|---|---|
| 1,470,973 | A | * | 10/1923 | Hancock | F04F 1/06 417/86 |
| 2,309,512 | A | | 1/1943 | Kirkpatrick | |
| 3,617,152 | A | * | 11/1971 | Cummings | F04F 1/18 417/147 |
| 4,021,147 | A | * | 5/1977 | Brekke | F04F 1/06 417/147 |
| 4,781,213 | A | | 11/1988 | Kilayko | |
| 5,074,758 | A | | 12/1991 | McIntyre | |
| 5,560,342 | A | | 10/1996 | Fournier et al. | |
| 5,878,925 | A | | 3/1999 | Denkins et al. | |
| 5,890,538 | A | | 4/1999 | Beirute et al. | |

(Continued)

FOREIGN PATENT DOCUMENTS

JP 2010-23244 2/2010

*Primary Examiner* — Charles G Freay

(74) *Attorney, Agent, or Firm* — Allen, Dyer et al.

(57) ABSTRACT

A pneumatic pump control system includes a pump chamber having a top end and a bottom end, an air valve coupled to the top end of the pump chamber and configured to be coupled to a pressurized air source, and a pump chamber valve coupled to the bottom end of the pump chamber. In addition, the pneumatic pump control system includes a discharge chamber having a top end and a bottom end, a discharge fitting coupled to the top end of the discharge chamber, a discharge check valve coupled to the bottom end of the discharge chamber in fluid communication with the pump chamber valve, and an inlet check valve in fluid communication with the pump chamber.

19 Claims, 5 Drawing Sheets

(56) References Cited

U.S. PATENT DOCUMENTS

| | | | | |
|---|---|---|---|---|
| 6,048,175 | A * | 4/2000 | Corlew | F04F 1/20<br>417/139 |
| 7,516,796 | B2 | 4/2009 | Bertane | |
| 2011/0067765 | A1 | 3/2011 | Army, Jr. et al. | |
| 2017/0274605 | A1 | 9/2017 | Nagata | |
| 2017/0321724 | A1 | 11/2017 | Breslin | |
| 2018/0313369 | A1 * | 11/2018 | Breslin | F04F 1/08 |

* cited by examiner

PNEUMATIC PUMP CONTROL SYSTEM

RELATED APPLICATION

This application is a continuation-in-part of pending U.S. patent application Ser. No. 16/163,120 filed Oct. 17, 2018 which claims benefit to U.S. provisional patent application Ser. No. 62/573,480 filed Oct. 17, 2017, all the contents of which are incorporated by reference in their entirety.

TECHNICAL FIELD

The present invention relates to the field of pneumatic pumps, and, more particularly, to a pneumatic pump control system.

BACKGROUND

Pneumatic pumps are currently used in oil wells, water wells, landfill leachate wells, and other types of wells. They operate by driving compressed air in a riser pipe within the well which, in turn, pumps liquid back up the riser pipe and out of the well.

A drawback of the pneumatic pumps is that often times air is introduced into the discharge when the well is pumped dry and over discharges. This over discharging causes premature failure of the pump assembly and more frequent maintenance.

It is desirable, therefore, to provide a pneumatic pump control system that prevents air from entering the discharge and over discharging, and can signal the end of operation.

SUMMARY

In a particular embodiment, a pneumatic pump control system is disclosed. The pneumatic pump control system includes a pump chamber having a top end and a bottom end, an air valve coupled to the top end of the pump chamber and configured to be coupled to a pressurized air source, and a pump chamber valve coupled to the bottom end of the pump chamber. In addition, the pneumatic pump control system includes a discharge chamber having a top end and a bottom end, a discharge fitting coupled to the top end of the discharge chamber, a discharge check valve coupled to the bottom end of the discharge chamber in fluid communication with the pump chamber valve, and an inlet check valve in fluid communication with the pump chamber.

The pump chamber valve may include a ball seat and a complementary ball that floats, and the inlet check valve and the discharge check valve each comprise a ball seat and a respective weighted ball. The pneumatic pump control system may also include a base to which the pump chamber and the discharge chamber are mounted, and the base houses the inlet check valve. The base may have a strainer that is configured to prevent debris from entering the inlet check valve.

In a particular aspect, the pump chamber and the discharge chamber may each comprise a hollow tube and an actuator may be coupled to the air valve and be configured to open and close the air valve.

A compressor may be coupled to the air valve, and a controller may be coupled to the actuator. The pump chamber may include a switch that is coupled to the controller and configured to indicate when the pump chamber is filled with liquid. The controller may also be configured to open the air valve to let air release from the pump chamber to fill the pump chamber with liquid, and to close the air valve and introduce pressurized air into the pump chamber to force the liquid from the pump chamber to the discharge chamber and out the discharge fitting. The inlet check valve and the discharge check valve may each comprise one of a ball check valve, swing check valve, stop-check valve, and silent check valve, and the discharge check valve comprises one of a ball check valve, swing check valve, stop-check valve, and silent check valve.

In yet another aspect, a method of operating a pneumatic pump control system comprising a pump chamber having a top end and a bottom end, an air valve coupled to the top end of the pump chamber and configured to be coupled to a pressurized air source, a pump chamber valve coupled to the bottom end of the pump chamber, a discharge chamber having a top end and a bottom end, a discharge fitting coupled to the top end of the discharge chamber, a discharge check valve coupled to the bottom end of the discharge chamber and in fluid communication with the pump chamber valve, and an inlet check valve in fluid communication with the pump chamber, is disclosed.

The method includes opening the air valve to cause liquid to flow into the pump chamber through the inlet check valve as air exits the pump chamber, and closing the air valve to stop the liquid from flowing into the pump chamber when a liquid level in the pump chamber reaches a predetermined high level, which closes the inlet check valve. The method also includes introducing air into the pump chamber to force the liquid out of the pump chamber and into the discharge chamber as the air displaces the liquid. Introducing air into the pump chamber may be terminated when the liquid level reaches a predetermined low level.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1-4, a pneumatic pump control system is shown and is designated generally as 100. The system 100 is placed in a well that is filled with liquid. For example, the well may be a landfill well and leachate is desired to be pumped from the well. The system described herein prevents air from entering the discharge and over discharging during the pumping operation.

The system 100 includes a pump chamber 102*a* and a discharge chamber 102*b*. At a top end of the pump chamber 102*a* is an air valve 104*a* that is configured to release air from the pump chamber 102*a* or to fill the pump chamber 102*a* with pressurized air as described in more detail below. A discharge fitting 104*b* is coupled to the top end of the discharge chamber 102*b*. The discharge fitting 104*b* may be connected to a discharge hose.

Proximate a bottom portion of the pneumatic pump control system 100 is a base 106 to which the pump chamber 102*a* and the discharge chamber 102*b* are mounted. The base 106 also includes a strainer 110 so that larger debris does not enter the pump chamber 102*a*. A bottom of the base 106 includes a plate 108 that is used to secure the strainer 110.

Figure 1:
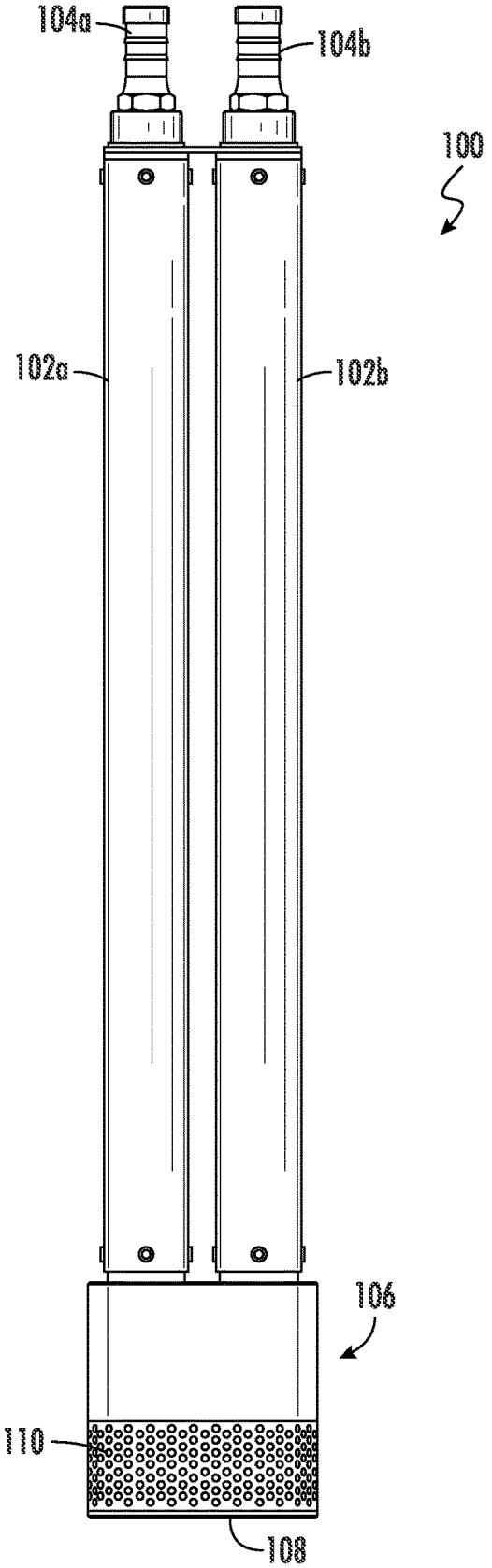
FIG. 1 is an elevational view of a pneumatic pump control system in accordance with an embodiment of the present invention.
Figure 2:
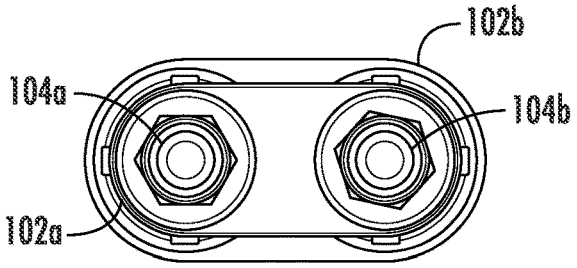
FIG. 2 is a top view of the pneumatic pump control system of FIG. 1.
Figure 3:
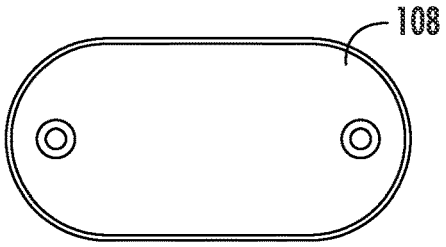
FIG. 3 is a bottom view of the pneumatic pump control system of FIG. 1.
Figure 5:
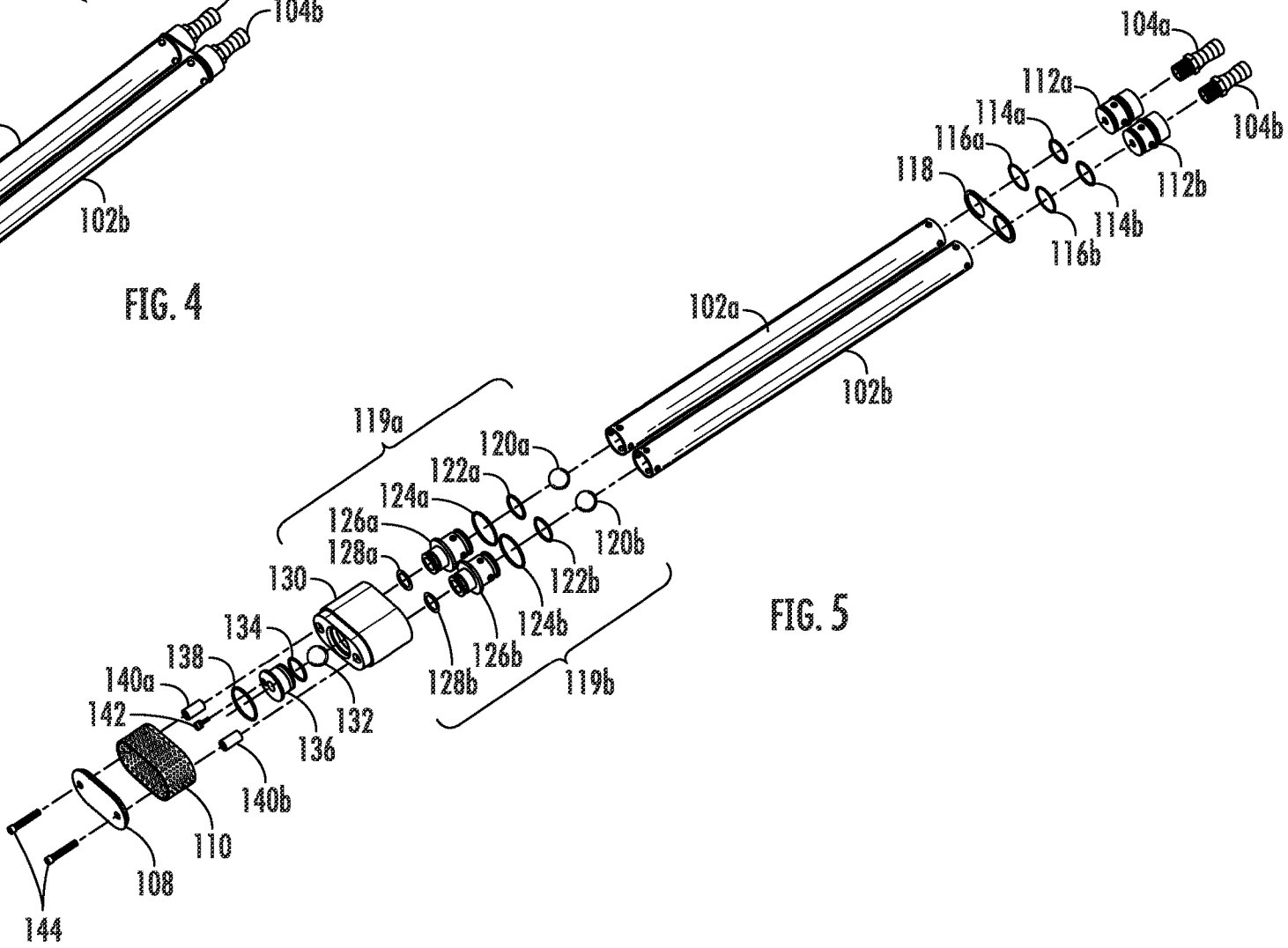
FIG. 5 is an exploded perspective view of the pneumatic pump control system of FIG. 1.
Figure 4:
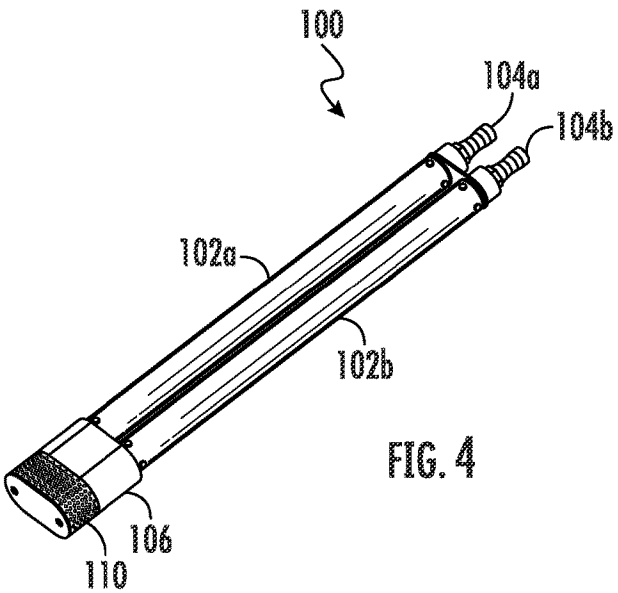
FIG. 4 is a perspective view of the pneumatic pump control system of FIG. 1.

Referring now to FIG. 5, an exploded perspective view of the pneumatic pump control system is shown. The pump chamber 102*a* and discharge chamber 102*b* are hollow tubes, for example. A pump endcap 112*a* is inserted into the top of the pump chamber 102*a*. A clamp 118 is used to secure the pump endcap 112*a* thereto. An O-ring 114*a* may be used along with a retaining ring 116*a* in order to make a water tight connection. The air valve 104*a* is snapped into the pump endcap 112*a*.

The discharge chamber 102*b* has a similar construction with a discharge endcap 112*b* that is inserted into the top of the discharge chamber 102*b*. An O-ring 114*b* and retaining ring 116*b* are used to secure the discharge endcap 112*b* to the discharge chamber 102*b*.

Moving to the bottom end of the pump chamber 102*a*, a pump chamber valve 119*a* is coupled to the bottom end. In a particular aspect the pump chamber valve 119*a* comprises a ball 120*a*. The ball 120*a* is configured to rest on a ball seat 126*a*. There is no flow through the pump chamber valve 119*a* when the ball 120*a* is resting on the ball seat 126*a*. The pump chamber valve 119*a* is opened when the ball 120*a* is floated upwards by liquid flowing up in to the pump chamber 102*a*. The pump chamber valve 119*a* remains open until the ball 120*a* returns to the ball seat 126*a*. The ball seat 126*a* is coupled to the pump chamber 102*a* using an O-ring 122*a* and a retaining ring 124*a*.

In contrast to the pump chamber valve 119*a*, the discharge check valve 119*b* allows flow in one direction. The discharge check valve 119*b* includes a weighted ball 120*b* in a particular aspect. Accordingly, the discharge check valve 119*b* is open only when the flow is upwards from the bottom portion towards the discharge fitting 104*b*. Otherwise, the discharge check valve 119*b* is closed and allows no flow as the weighted ball 120*b* is seated on a ball seat 126*b*. The ball seat 126*b* is coupled to the discharge chamber 102*b* using O-ring 122*b* and retaining ring 124*b*. In addition O-rings 128*a*, 128*b* are used for a water tight connection to the base 130.

The base 130 houses an inlet check valve 121 that includes a weighted ball 132 and a ball seat 136. In addition, a screw 142 is used to secure the ball seat 136 to the base 130 along with the O-rings 134, 138 and retaining ring 138 to make a water tight connection. The strainer 110 is secured to a bottom portion of the base 130 using supports 140*a*, 140*b* and bolts 144.

Figure 6:
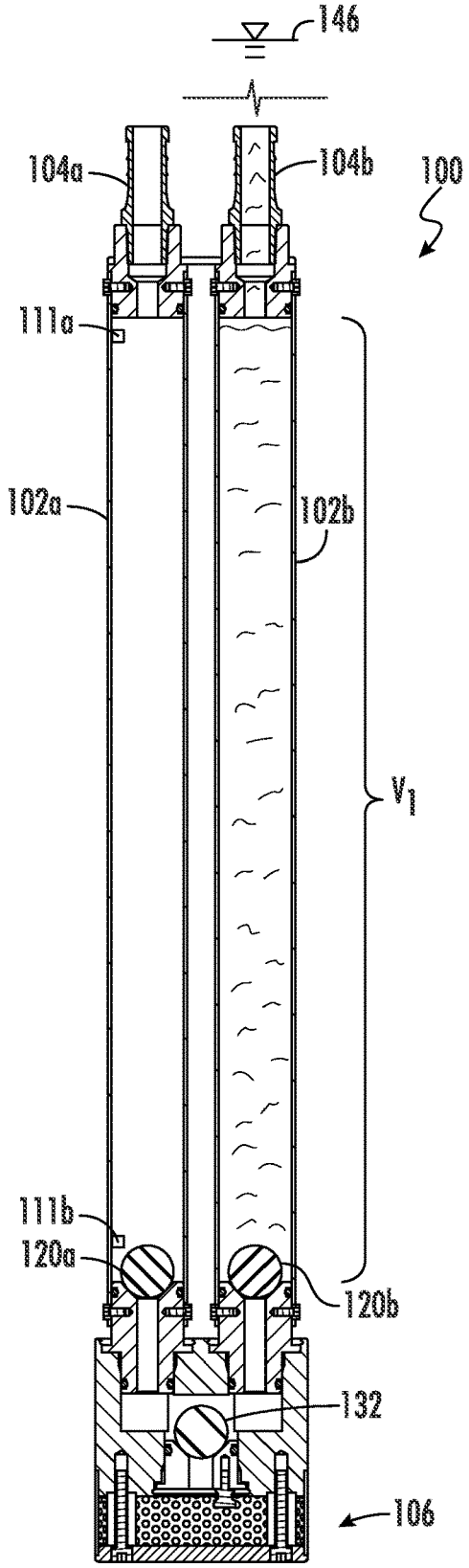
FIG. 6 is a schematic cross sectional view with a pump chamber of the pneumatic pump control system ready to begin filling.

Referring now to FIGS. 6-10, the operation of the pneumatic pump control system 100 is illustrated through schematic cross sectional views. As shown in FIG. 6, the pump chamber 102*a* is empty. The discharge chamber 102*b* is shown filled with liquid having a volume of V1. The ball 120*a* is seated as well as weighted balls 120*b* and 132 so that pump chamber valve 119, discharge check valve 119*b*, and inlet check valve 121 are all closed. The air valve 104*a* is also closed.

In order for liquid to enter the pump chamber 102*a*, the air valve 104*a* is opened, which allows air to exit the pump chamber 102*a* as the liquid displaces the air. As long as the air valve 104*a* is closed (or compressed air is being introduced into the pump chamber 102*a*), liquid cannot enter the pump chamber 102*a* through the inlet check valve 121.

Accordingly, the inlet check valve 121 is configured to close when the air valve 104*a* is closed or compressed air is introduced into the pump chamber 102*a* through the air valve 104*a*. The inlet check valve 121 may comprise a ball check valve with the weighted ball 132 having sufficient weight to sink down over the ball seat 136 when the air valve 104*a* is closed or when introducing compressed air into the pump chamber 102*a* but allows liquid to push it upwards and to the side in a wobbling type motion as the liquid rushes into the pump chamber 102*a*. As those of ordinary skill in the art can appreciate, the inlet check valve 121 can include any type of check valve in addition to a ball check valve such as a swing check valve, a stop-check valve, or a silent check valve, for example.

The pump chamber valve 119*a* may include the ball 120*a* that can float and is configured to rise and sink with the level of the liquid level of the pump chamber 102*a* in contrast with the weighted ball 120*b* of the discharge check valve 119*b* and inlet check valve 121 (or other similar one-way check valves known to those of ordinary skill in the art).

Once the pump chamber 102*a* is filled with liquid, pressurized or compressed air can be introduced that forces the liquid back down through the pump chamber valve 119*a* and up through the discharge check valve 119*b*. The inlet check valve 121 remains closed once the pressurized air begins to displace the liquid in the pump chamber 102*a*.

Figure 7:
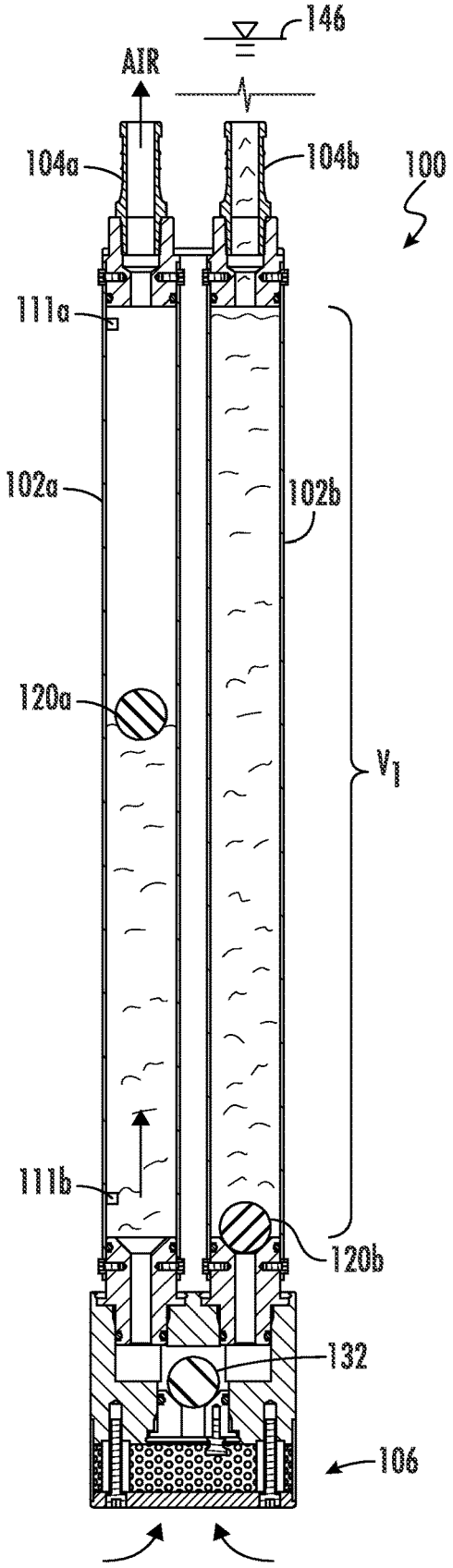
FIG. 7 is a schematic cross sectional view with the rising liquid level in the pump chamber.
Figure 8:
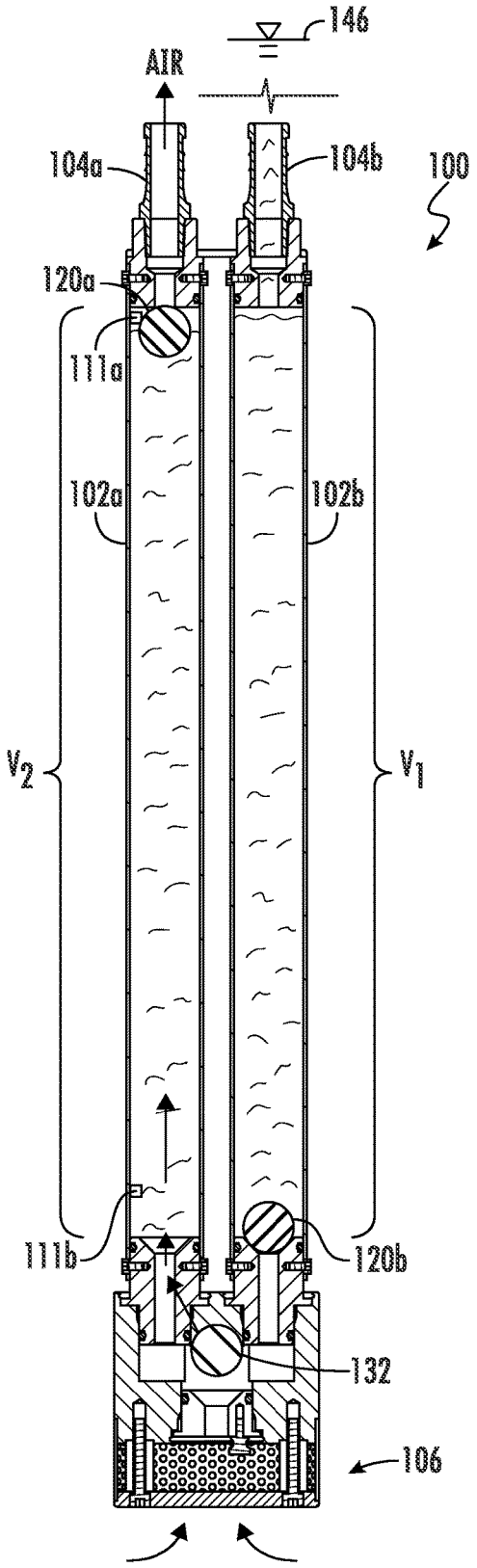
FIG. 8 is a schematic cross sectional view with the pump chamber filled with liquid.

In operation, the system 100 is placed into an area where liquid is desired to be removed. This could be down a well or within a landfill having a high water level, for example. The pumping operation begins by opening valve 104*a* as shown in FIG. 7, allowing liquid to rush in through the inlet check valve 121 and into the pump chamber 102*a*. The liquid level continues to rise as shown in FIG. 8, and the ball 120*a* within the pump chamber 102*a* floats upwards.

Figure 9:
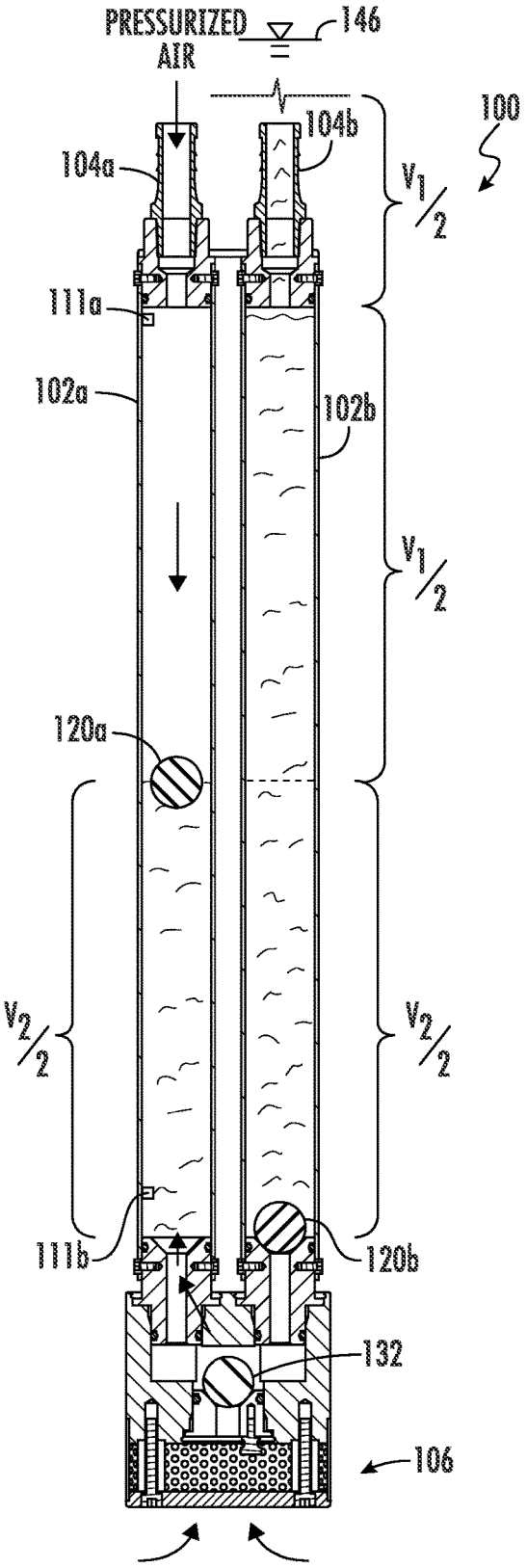
FIG. 9 is a schematic cross sectional view showing pressurized air being introduced into the pump chamber and causing the liquid in the pump chamber to flow to the discharge chamber.

Once the liquid level reaches the desired predetermined high level in the pump chamber 102*a*, as shown in FIG. 9, a pressure sensor 105 or an upper switch 111*a* coupled to a controller 204 may begin to cause the compressed air to be introduced into the pump chamber 102*a* through the air valve 104*a*. This action (in addition to the air valve 104*a* not allowing air to escape from the pump chamber 102*a*) causes the inlet check valve 121 to close to prevent liquid flowing in (or out) through the inlet check valve 121. The liquid (V1) that was in discharge chamber 102*b* is being displaced by the liquid (V2) from the pump chamber 102*a*. As shown in FIG. 9 as an example, half of the liquid of the discharge chamber 102*b* has been displaced and otherwise discharged from the discharge chamber 102*b*. The pump chamber 102*a* is now half filled with air and half filled with liquid. The discharge check valve 119*b* allows liquid to push it upwards and to the side in a wobbling type motion as the liquid rushes into the discharge chamber 102*b* in one direction.

Figure 10:
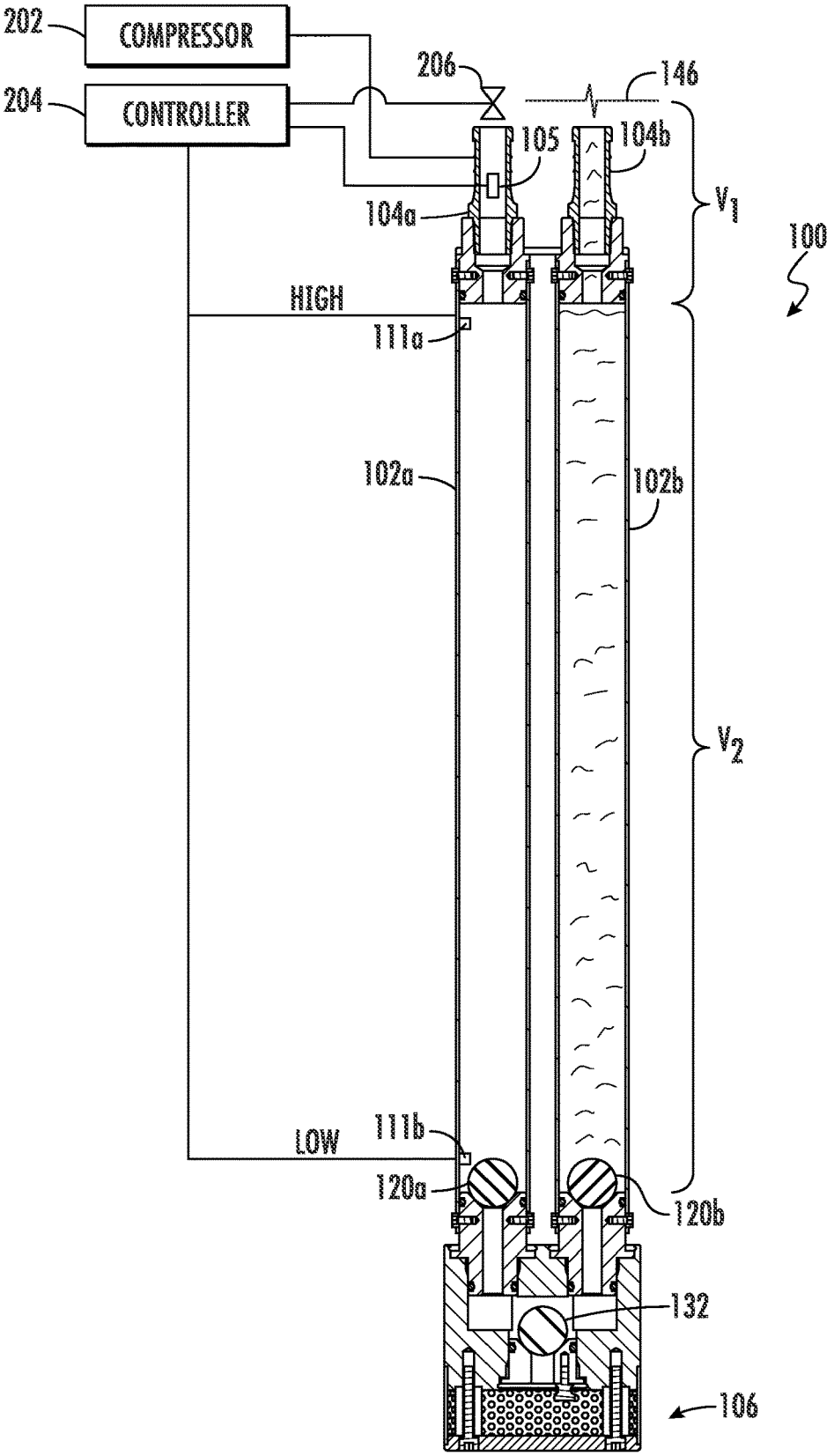
FIG. 10 is a schematic cross sectional view showing the liquid from the pump chamber completely emptied into the discharge chamber.

The pressurized air continues to be introduced into the pump chamber 102*a* as shown in FIG. 10, which results in the liquid level continuing to lower inside the pump chamber 102*a*. A compressor 202 may be coupled to the air valve 104*a*, and the controller 204 may be coupled to an actuator 206 coupled to the air valve 104*a* and configured to open and close the air valve 104*a* in response to the controller 204 detecting a rapid increase in chamber pressure from the pressure sensor 105 to indicate the end of the cycle. Alternatively, a lower switch 111*b* may be coupled to the controller 204 and indicate the end of the cycle.

Once the liquid level reaches the desired predetermined low level in the pump chamber 102*a*, as shown in FIG. 10, the controller 204 discontinues introducing compressed air into the pump chamber 102*a* through the air valve 104*a*. This prevents over discharging and damaging the pumping equipment.

At this point the liquid (V2) from the pump chamber 102*a* has been transferred to the discharge chamber 102*b* and the liquid (V1) that was previously in the discharge chamber 102*b* has been discharged.

The controller 204 then opens the air valve 104*a* to allow liquid to enter the pump chamber 102*a* again, as shown in FIG. 7, and the process repeats. The cycling of the compressed air and the operation of the air valve 104*a* can be controlled by the controller 204 coupled to at least one pressure sensor 105 or other similar sensor to operate the pneumatic pump most efficiently. The controller 204 may comprise a microcontroller than has a processor coupled to a memory and can be programmed to detect an end of the pumping cycle from the pressure sensor 105. The end of the pumping cycle can be detected based on a rapid increase in pressure in the pump chamber 102*a* that indicates that the chamber 102*a* has been fully discharged because the ball 120*a* is resting on its ball seat 126*a* and blocking any more air from being discharged. The pump chamber valve 119*a* coupled to the bottom end of the pump chamber 120*a* is configured to cause an increase in a pressure within the pump chamber 120*a* when closed to indicate an end of a pumping cycle.

In a particular aspect, a method of operating a pump control system described above includes opening the air valve 104*a* to cause liquid to flow into the pump chamber 102*a* through the inlet check valve 121 as air exits the pump chamber 102*a*, and closing the air valve 104*a* to stop the liquid from flowing into the pump chamber 102*a* when a liquid level in the pump chamber 102*a* reaches a predetermined high level, which closes the inlet check valve 121. The method also includes introducing air into the pump chamber 102*a* to force the liquid out of the pump chamber 102*a* and into the discharge chamber 102*b* as the air displaces the liquid. Introducing air into the pump chamber 102*a* may be terminated when the liquid level reaches a predetermined low level that can be detected by a pressure sensor 105 or a switch 111*b* so that the pump operates efficiently.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A pneumatic pump and control system comprising:

a pump chamber having a top end and a bottom end;

an air valve coupled to the top end of the pump chamber and configured to be coupled to a pressurized air source;

a pump chamber valve coupled to the bottom end of the pump chamber and configured to cause an increase in a pressure within the pump chamber when closed to indicate an end of a pumping cycle;

a pressure sensor configured to determine the pressure within the pump chamber;

a discharge chamber having a top end and a bottom end;

a discharge fitting coupled to the top end of the discharge chamber;

a discharge check valve coupled to the bottom end of the discharge chamber and in fluid communication with the pump chamber valve; and an inlet check valve in fluid communication with the pump chamber.

2. The pneumatic pump and control system of claim 1, wherein the pump chamber valve comprises a ball seat and a complementary ball that floats.

3. The pneumatic and control system of claim 1, wherein the inlet check valve and the discharge check valve each comprise a ball seat and a respective weighted ball.

4. The pneumatic pump and control system of claim 1, further comprising a base to which the pump chamber and the discharge chamber are mounted, and the base houses the inlet check valve.

5. The pneumatic pump and control system of claim 4, wherein the base comprises a strainer configured to prevent debris from entering the inlet check valve.

6. The pneumatic pump and control system of claim 1, wherein the pump chamber and the discharge chamber each comprise a hollow tube.

7. The pneumatic pump and control system of claim 1, further comprising an actuator coupled to the air valve and configured to open and close the air valve.

8. The pneumatic pump and control system of claim 7, wherein the pressurized air source comprises a compressor coupled to the air valve.

9. The pneumatic pump and control system of claim 7, further comprising a controller coupled to the actuator.

10. The pneumatic pump and control system of claim 9, wherein the pump chamber further comprises a switch coupled to the controller and configured to indicate when the pump chamber is filled with liquid.

11. The pneumatic pump and control system of claim 10, wherein the controller is configured to open the air valve to let air release from the pump chamber to fill the pump chamber with liquid, and the controller is configured to close the air valve and introduce pressurized air into the pump chamber to force the liquid from the pump chamber to the discharge chamber and out the discharge fitting.

12. The pneumatic pump and control system of claim 1, wherein the inlet check valve comprises one of a ball check valve, swing check valve, stop-check valve, and silent check valve.

13. The pneumatic pump and control system of claim 1, wherein the discharge check valve comprises one of a ball check valve, swing check valve, stop-check valve, and silent check valve.

14. A pneumatic pump comprising:

a pump chamber having a top end and a bottom end;

an air valve in communication with the pump chamber;

a pump chamber valve coupled to the bottom end of the pump chamber;

a discharge chamber having a top end and a bottom end;

a discharge check valve coupled to the bottom end of the discharge chamber and in fluid communication with the pump chamber valve;

an inlet check valve in fluid communication with the pump chamber;

a pressurized air source to supply pressurized air to the pump chamber; and a switch configured to indicate when the pump chamber is filled with liquid.

15. The pneumatic pump of claim 14, further comprising a controller coupled to the pressurized air source and the switch, the controller configured to control filling the pump chamber with liquid and to introduce the pressurized air into the pump chamber to force the liquid from the pump chamber to the discharge chamber and out the discharge fitting.

16. The pneumatic pump of claim 14, wherein the inlet check valve and the discharge check valve each comprise a ball seat and a respective ball.

17. The pneumatic pump of claim 14, wherein the inlet check valve and the discharge check valve each comprise one of a ball check valve, swing check valve, stop-check valve, and silent check valve.

18. A method of operating a pneumatic pump and control system comprising a pump chamber having a top end and a bottom end, an air valve coupled to the top end of the pump chamber and configured to be coupled to a pressurized air source, a pump chamber valve coupled to the bottom end of the pump chamber, a discharge chamber having a top end and a bottom end, a discharge fitting coupled to the top end of the discharge chamber, a discharge check valve coupled to the bottom end of the discharge chamber and in fluid communication with the pump chamber valve, and an inlet check valve in fluid communication with the pump chamber, the method comprising:

opening the air valve to cause liquid to flow into the pump chamber through the inlet check valve as air exits the pump chamber;

closing the air valve to stop the liquid from flowing into the pump chamber when a liquid level in the pump chamber reaches a predetermined high level, which closes the inlet check valve; and introducing air into the pump chamber to force the liquid out of the pump chamber and into the discharge chamber as the air displaces the liquid.

19. The method of claim 18, wherein the introducing air into the pump chamber is terminated when the liquid level reaches a predetermined low level.

* * * * *